US010626637B2

(12) United States Patent
Yu

(10) Patent No.: US 10,626,637 B2
(45) Date of Patent: Apr. 21, 2020

(54) PADLOCK WITH INDICATION DEVICE

(71) Applicant: Chun Te Yu, Changhua County (TW)

(72) Inventor: Chun Te Yu, Changhua County (TW)

( * ) Notice: Subject to any disclaimer, the term of this patent is extended or adjusted under 35 U.S.C. 154(b) by 96 days.

(21) Appl. No.: 15/860,116

(22) Filed: Jan. 2, 2018

(65) Prior Publication Data

US 2018/0119457 A1 May 3, 2018

Related U.S. Application Data

(63) Continuation of application No. 14/705,510, filed on May 6, 2015, now Pat. No. 9,890,567, which is a continuation of application No. 13/541,855, filed on Jul. 5, 2012, now abandoned, which is a continuation of application No. 12/814,183, filed on Jun. 11, 2010, now Pat. No. 8,256,250, which is a continuation-in-part of application No. 11/491,258, filed on Jul. 24, 2006, now Pat. No. 7,770,421, which is a continuation-in-part of application No. 11/032,116, filed on Jan. 11, 2005, now Pat. No. 7,100,401.

(30) Foreign Application Priority Data

Nov. 23, 2004 (TW) ..... 93218813 U

(51) Int. Cl.

| | |
|---|---|
| ***E05B 67/06*** | (2006.01) |
| ***E05B 37/02*** | (2006.01) |
| ***E05B 39/00*** | (2006.01) |

(52) U.S. Cl.

CPC ..... *E05B 67/06* (2013.01); *E05B 37/025* (2013.01); *E05B 39/00* (2013.01); *Y10T 70/40* (2015.04); *Y10T 70/413* (2015.04); *Y10T 70/415* (2015.04)

(58) Field of Classification Search

CPC ..... E05B 67/06; E05B 37/025; E05B 39/00; Y10T 70/40; Y10T 70/413; Y10T 70/415

USPC ..... 70/21, 25, 26, 284, 285, 432–441, 38 A, 70/38 R, 38 B

See application file for complete search history.

(56) References Cited

U.S. PATENT DOCUMENTS

| | | | |
|---|---|---|---|
| 827,177 | A | 7/1906 | Pixley |
| 972,171 | A | 11/1910 | Dupont |
| 1,411,123 | A | 3/1922 | Nadolny |
| 1,819,813 | A | 8/1931 | Ellenberger |
| 2,395,762 | A | 2/1946 | Rober |
| 3,808,848 | A | 5/1974 | Yang |
| 3,824,819 | A | 7/1974 | Neary |

(Continued)

*Primary Examiner* — Suzanne L Barrett
(74) *Attorney, Agent, or Firm* — Muncy, Geissler, Olds & Lowe, P.C.

(57) ABSTRACT

A padlock includes a shell, a shackle, a button and an indicator. The shackle has a long leg, a short leg and an arch section extending between the long and short legs. The short leg is rotatable about the long leg. The button is movable to a blocking position to block the short leg from rotation about the long leg, and to an unblocking position to permit the rotation of the short leg about the long leg. The key-operated lock core is configured to drive the button in one direction to the blocking position and in a reverse direction to the unblocking position. The indicator is movable with respect to the key-operated lock core and the button. The indicator is movable from an original position, toward a first horizontal level that is tangent to the vertex of the arch section of the shackle, to an indicative position outside the shell.

16 Claims, 12 Drawing Sheets

(56) References Cited

U.S. PATENT DOCUMENTS 3,837,189 A 9/1974 Atkinson
5,377,511 A 1/1995 Meckbach
6,047,577 A 4/2000 Klimas
6,516,643 B1 2/2003 Olshausen
6,877,345 B1 4/2005 Misner et al.
6,997,023 B1 2/2006 Huang
7,007,521 B1 3/2006 Misner et al.
7,047,773 B1 5/2006 Lin
7,100,401 B2 9/2006 Yu
7,114,356 B1 * 10/2006 Yu ..... E05B 37/0034 70/21
7,140,209 B2 11/2006 Lai
7,159,422 B1 1/2007 Misner et al.
7,204,108 B2 4/2007 Yu
7,210,318 B2 5/2007 Yu
7,216,517 B2 5/2007 Ling et al.
7,225,648 B2 6/2007 Lai et al.
7,340,927 B2 3/2008 Yu et al.
7,357,007 B2 * 4/2008 Lin ..... E05B 35/105 70/21
7,363,782 B1 4/2008 Misner et al.
7,370,497 B2 5/2008 Yu
7,434,426 B2 10/2008 Loughlin et al.
7,493,785 B2 2/2009 Yu et al.
7,520,150 B2 * 4/2009 Yu ..... A45C 13/10 70/21
7,523,628 B2 4/2009 Yu
7,562,545 B2 7/2009 Lai et al.
7,628,045 B2 * 12/2009 Yu ..... E05B 37/025 70/21
7,770,421 B2 * 8/2010 Yu ..... E05B 35/105 70/21
7,779,657 B2 8/2010 Yu
7,934,406 B2 5/2011 Loughlin et al.
9,890,567 B2 * 2/2018 Yu ..... E05B 37/025
2002/0088256 A1 * 7/2002 Taylor ..... E05B 37/16 70/25
2004/0226323 A1 11/2004 Loughlin et al.
2004/0226324 A1 * 11/2004 Loughlin ..... E05B 35/008 70/25
2005/0034492 A1 2/2005 Yu
2005/0039500 A1 * 2/2005 Yu ..... E05B 35/105 70/25
2005/0039501 A1 2/2005 Yu
2005/0044901 A1 3/2005 Yu
2005/0092036 A1 5/2005 Lai
2005/0126233 A1 6/2005 Yu
2005/0132762 A1 6/2005 Yu
2005/0235706 A1 10/2005 Ling et al.
2005/0262902 A1 * 12/2005 Ling ..... E05B 37/0034 70/21
2006/0107709 A1 5/2006 Yu
2006/0107710 A1 5/2006 Yu
2006/0130540 A1 6/2006 Lin
2006/0225469 A1 10/2006 Yu
2006/0260369 A1 * 11/2006 Lai ..... E05B 37/025 70/38 C
2006/0266084 A1 * 11/2006 Kuo ..... E05B 35/105 70/21
2007/0227202 A1 * 10/2007 Yen ..... E05B 35/105 70/21
2007/0271969 A9 11/2007 Yu et al.
2008/0011026 A1 1/2008 Huang
2008/0016922 A1 1/2008 Yu
2008/0060390 A1 3/2008 Yu et al.
2008/0098774 A1 5/2008 Huang
2008/0156046 A1 7/2008 Yu
2008/0178649 A1 7/2008 Yu
2008/0307839 A1 12/2008 Yu
2009/0031764 A1 2/2009 Huang
2009/0113947 A1 5/2009 Lai et al.
2009/0188282 A2 7/2009 Loughlin et al.
2010/0037663 A1 2/2010 Yu
2010/0095718 A1 4/2010 Lai et al.
2010/0242551 A1 9/2010 Yu
2010/0307204 A1 12/2010 Yu
2011/0138865 A1 6/2011 Loughlin et al.

* cited by examiner

PADLOCK WITH INDICATION DEVICE

CROSS REFERENCE TO RELATED APPLICATIONS

This is a continuation of co-pending application Ser. No. 14/705,510, filed May 6, 2015, which is a continuation of U.S. application Ser. No. 13/541,855, filed Jul. 5, 2012, now abandon, which is a continuation of application Ser. No. 12/814,183, filed Jun. 11, 2010, which issued as U.S. Pat. No. 8,256,250 on Sep. 4, 2012, which is a continuation-in-part of U.S. application Ser. No. 11/491,258, filed on Jul. 24, 2006, which issued as U.S. Pat. No. 7,770,421 on Aug. 10, 2010, which is a continuation-in-part of U.S. application Ser. No. 11/032,116 filed on Jan. 11, 2005, which issued as U.S. Pat. No. 7,100,401 on Sep. 5, 2006, for which priority is claimed under 35 U.S.C. § 120; and this application claims priority of Application No. 093218813 filed in Taiwan, R.O.C. on Nov. 23, 2004 under 35 U.S.C. § 119; the entire contents of all of which are hereby incorporated by reference.

BACKGROUND OF THE INVENTION

1. Field of the Invention

The present invention relates to a padlock and, more particularly, to a padlock with an indication device for reminding a padlock owner whose padlock has been operated or used and luggage may have been inspected by the customs.

2. Brief Description of the Related Art

A conventional dual lock or padlock generally includes a shell, a shackle installed on the shell, a first locking mechanism installed on the shell to lock and unlock the shackle, and a second locking mechanism installed on the shell to lock and unlock the shackle. The first locking mechanism can only be unlocked by a padlock owner while the second locking mechanism can be unlocked only by a specific key. The specified key is often held by a customs inspector who is authorized to unlock the second locking mechanism of the padlock when it is necessary to open and check a luggage, a case or a bag subject to the lock or padlock without breaking it. Then, the inspector can re-lock the lock or padlock via the second locking mechanism by the specified key after inspecting the luggage, case or bag. However, an owner of such a luggage, case or bag cannot judge by the appearance of the lock or padlock if the lock or padlock has been operated or used and the luggage, case or bag has been checked that would cause great inconvenience to the owner.

SUMMARY OF THE INVENTION

The primary objective of the present invention is to provide a padlock capable of reminding a padlock owner whose padlock has been operated or used and luggage may have been inspected by the customs.

In an embodiment of the present invention, a padlock comprises a shell, a shackle, a lock mechanism and an indicator. The shell includes an opening made in a wall thereof to communicate an interior space of the shell and the out of the shell. The shackle is mounted on the shell and formed with a long leg movably inserted in the shell and a short leg extending from the long leg so that they are movable together. The lock mechanism is mounted on the shell, and includes a lock core and a limit knob. The lock core is inserted in the shell. The limit knob comprises a driving member and a button. The driving member is movable within the interior space of the shell via the opening. The button is coupled to the driving member and located out of the shell. The driving member is movable by the lock core so as to drive the button to engage with or disengage from the short leg of the shackle. The indicator is disposed in the opening of the shell and capable of moving along a surface of the driving member from the opening of the shell to an indicative position out of the shell by operating the lock core of the lock mechanism.

Further benefits and advantages of the present invention will become apparent after a careful study of the detailed description with reference to the accompanying drawings.

BRIEF DESCRIPTION OF THE DRAWINGS

The present invention will be described via detailed illustration of the preferred embodiment referring to the drawings wherein.

DETAILED DESCRIPTION OF THE PREFERRED EMBODIMENTS

FIGS. 1-10 show a padlock according to a first embodiment of the present invention. As shown in FIGS. 1-5, the padlock comprises a shell 1, a shackle 2, a lock mechanism 4, and an indicator 5. The lock mechanism 4 can be a key-operated lock mechanism or a combination lock mechanism. In the first embodiment, the lock mechanism 4 is a key-operated lock mechanism.

Figure 8:
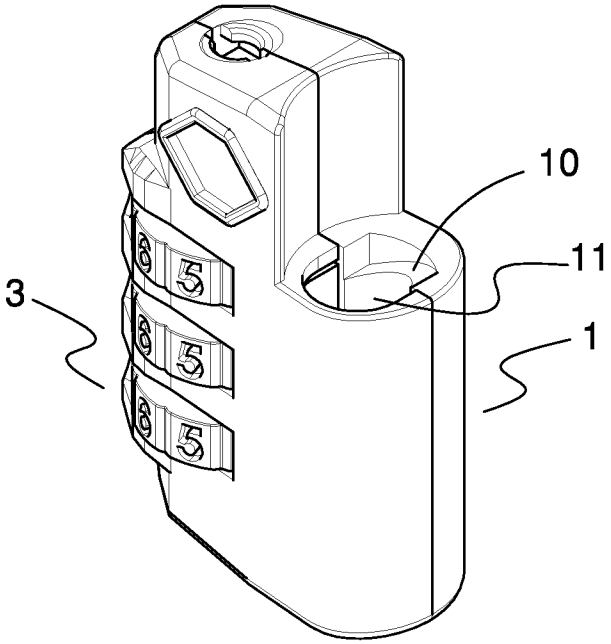
FIG. 8 is a perspective partial view of the padlock shown in FIG. 1.

In the first embodiment, the shell 1 includes an opening 11, as can be seen in FIG. 8, in a wall thereof to communicate an interior space of the shell 1 with the exterior of the shell 1. The shackle 2 is substantially U-shaped and mounted on the shell 1. The shackle 2 is formed with a long leg 20 movably inserted in the shell 1 and a short leg 21 extending from the long leg 20 so that they are movable together.

The lock mechanism 4 is mounted on the shell 1, and includes a lock core 41 and a limit knob 40. The lock core 41 is inserted in the shell 1. The limit knob 40 comprises a driving member 404 and a button 405. The driving member 404 is movable within the interior space of the shell 1 via the opening 11 of the shell 1. The button 405 is coupled to the driving member 404 and located out of the shell 1. The driving member 404 is movable by the lock core 41 so as to drive the button 405 to engage with or disengage from the short leg 21 of the shackle 2. Additionally, the button 405 of the limit knob 40 includes a top face formed with a recess 400 for receiving an end 210 of the short leg 21 of the shackle 2. The recess 400 includes an open end at a periphery of the limit knob 40.

Moreover, the indicator 5 is inserted in the opening 11 of the shell 1 and is capable of moving along a surface of the driving member 404 from the opening 11 of the shell 1 to an indicative position outside the shell 1 by operating the lock core 41 of the lock mechanism 4, as shown in FIGS. 5-10.

Figure 4:
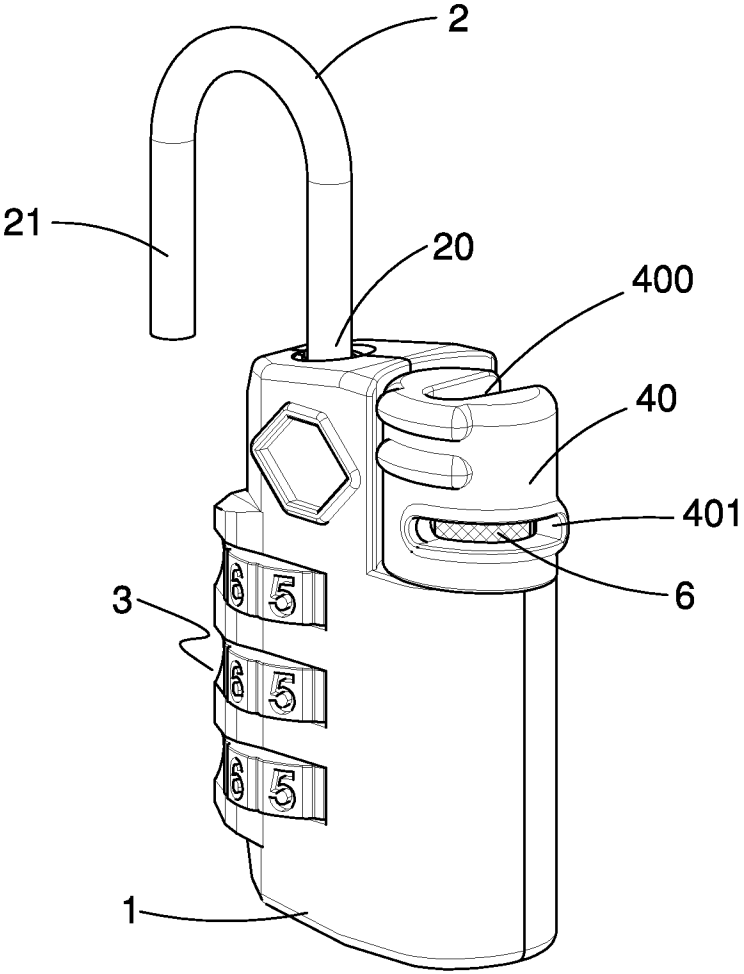
FIG. 4 is a perspective view of the padlock in another position than that is shown in FIG. 3.
Figure 6:
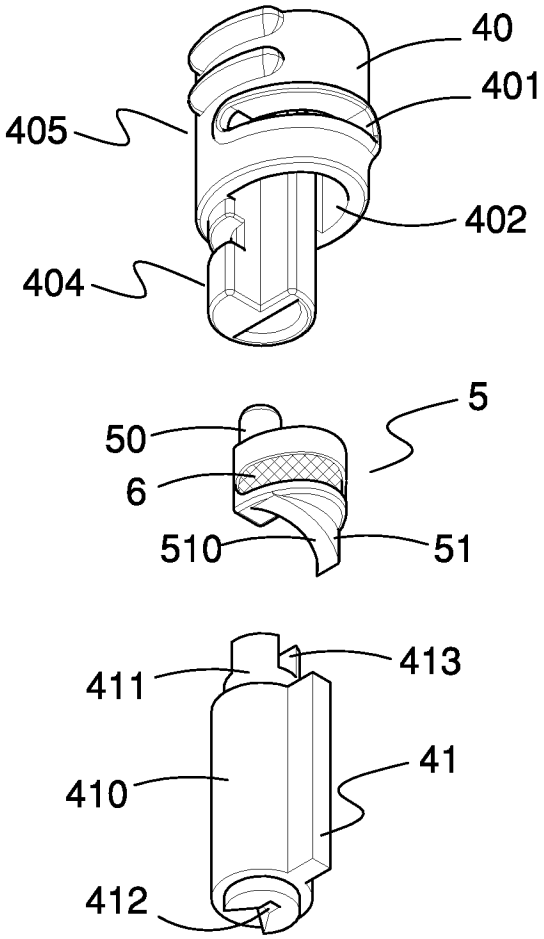
FIG. 6 is another exploded partial view of the padlock shown in FIG. 1.
Figure 5:
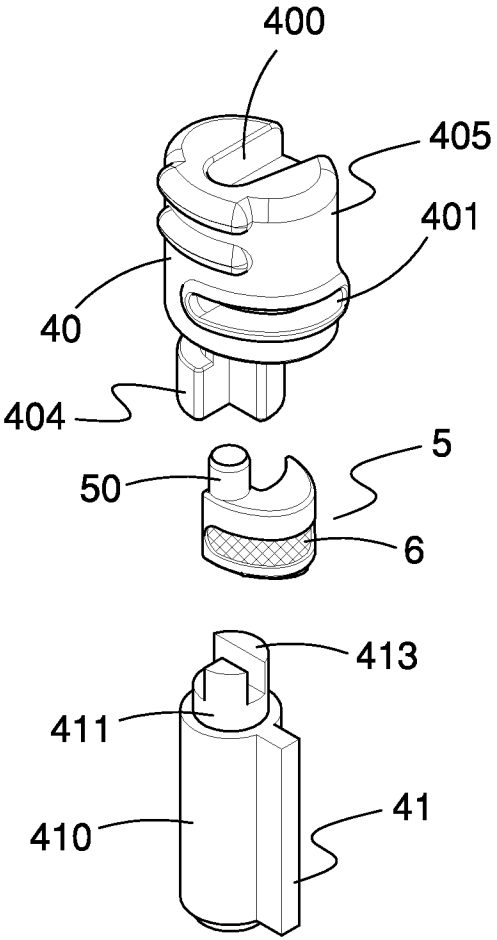
FIG. 5 is an exploded partial view of the padlock shown in FIG. 1.

Referring to FIGS. 4-6, the indicator 5 is formed with an indication portion 6. The button 405 of the limit knob 40 includes a window 401 made in the periphery. In the first embodiment, the indication portion 6 of the indicator 5 is visible from the window 401 of the button 405 when the indicator 5 is in the indicative position.

As described above, the lock mechanism 4 is a key-operated lock mechanism. Accordingly, the lock core 41 of the lock mechanism 41 comprises a body 410 and a rotor 411. The rotor 411 is movably received in the body 410, and includes one end made with a keyhole portion 412, and the other end made with a driving portion 413 extending from the body 410 for connecting with the limit knob 40. The keyhole portion 412 of the rotor 411 is arranged for receiving a matching key (not shown). When the matching key is inserted into the keyhole portion 412, the driving portion 413 can accordingly move the limit knob 40.

In addition, the padlock further comprises a combination lock core 3, which is inserted in the shell 1 for locking and unlocking the long leg 20 of the shackle 2, as shown in FIGS. 1-4.

Figure 2:
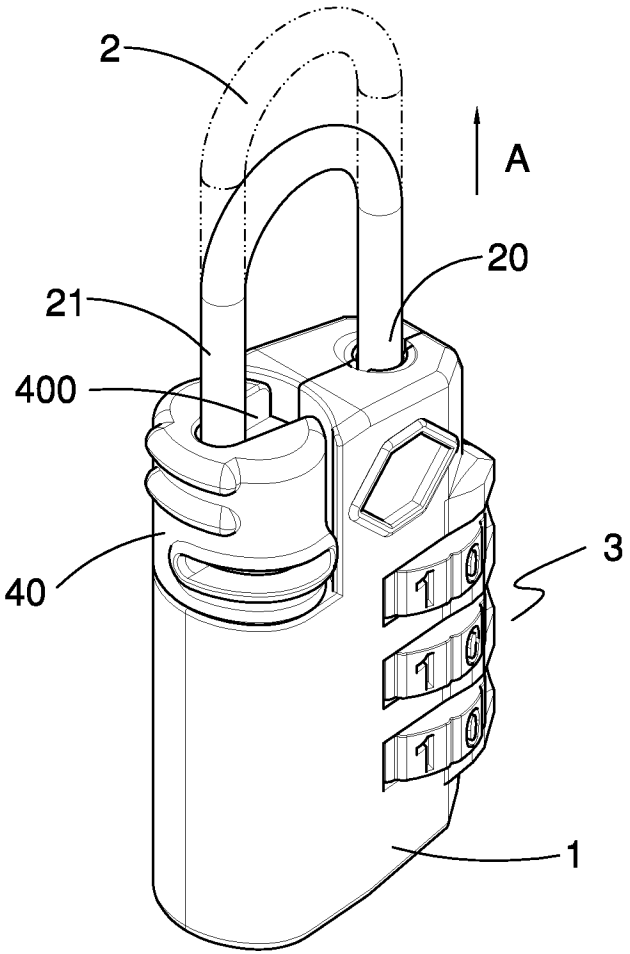
FIG. 2 is a perspective view of the padlock shown in FIG. 1.
Figure 1:
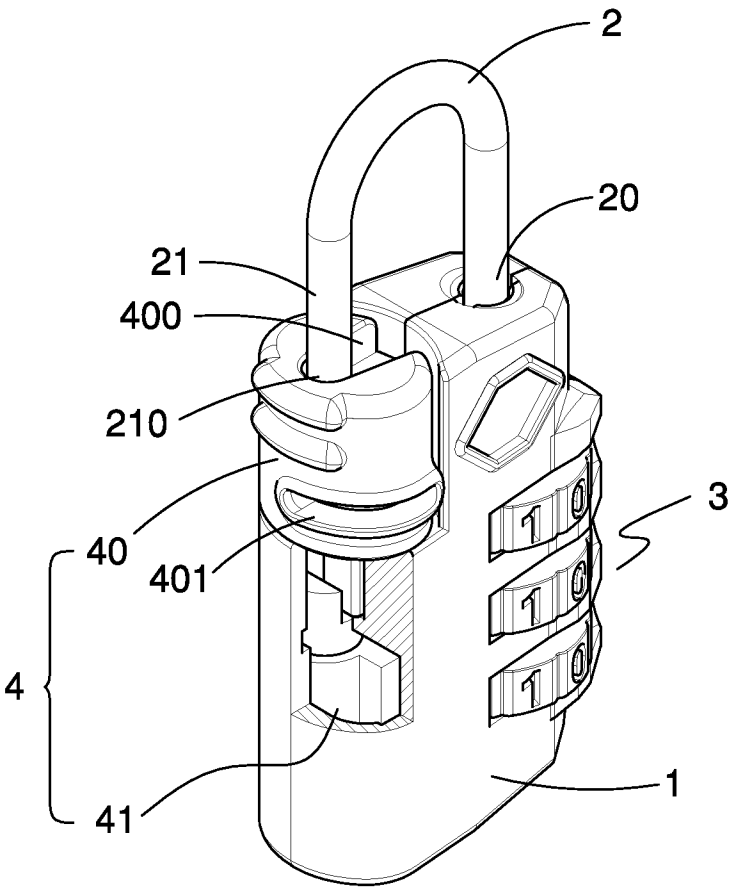
FIG. 1 is a cutaway view of a padlock in accordance with a first embodiment of the present invention.

FIG. 2 shows that the open end of the recess 400 of the limit knob 40 is directed toward the shell 1 and sealed by the shell 1, and the short leg 21 of the shackle 2 is inserted in the recess 400 of the limit knob 40 of the lock mechanism 4 and stopped by the limit knob 40 from rotating about the long leg 20, thus forming a locked state. When the combination lock core 3 is unlocked, the long leg 20 of the shackle 2 is unlocked from the combination lock core 3 so that the shackle 2 is movable upward indicated by an arrow head A, so as to detach the short leg 21 of the shackle 2 from the recess 400 of the limit knob 40 of the lock mechanism 4, thereby forming an unlocked state.

Figure 3:
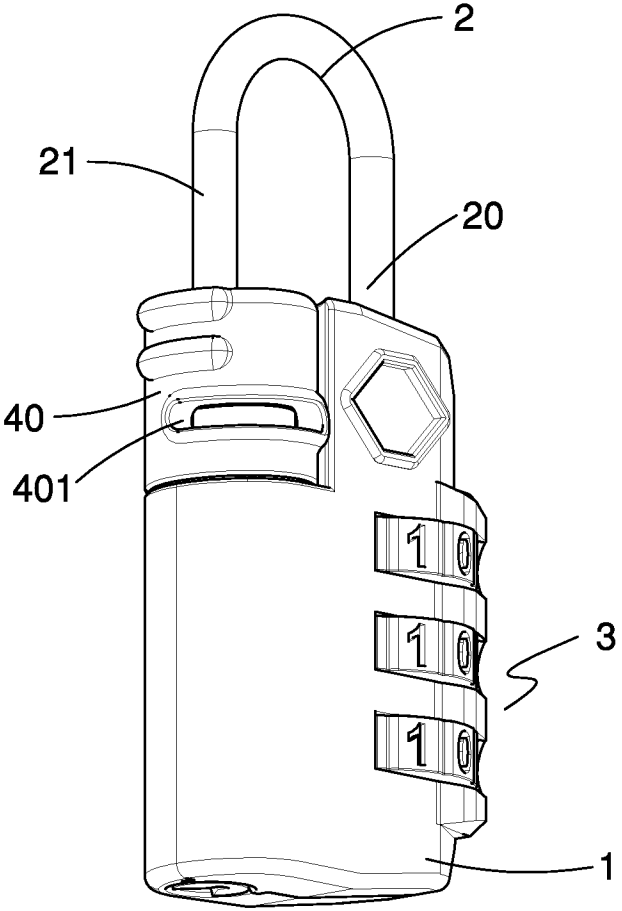
FIG. 3 is another perspective view of the padlock shown in FIG. 1.

Referring to FIG. 3, when the combination lock core 3 is locked, the long leg 20 of the shackle 2 is locked by the combination lock core 3 and unable to move upward. That is, the short leg 21 of the shackle 2 is stopped by the limit knob 40, thereby forming a locked state.

In FIG. 4, when the limit knob 40 of the lock mechanism 4 is moved by the lock core 41 via the matching key, the open end of the recess 400 of the limit knob 40 is released from the shell 1. Accordingly, the short leg 21 of the shackle 2 is released from the recess 400 of the limit knob 40 and can be rotated about the long leg 20 of the shackle 2, thereby forming an unlocked state.

FIG. 5 shows that the indicator 5 is movably mounted on the driving member 404 of the limit knob 40 of the lock mechanism 4 and includes a protruding portion formed on a first side and hereinafter named as the "shaft 50", directed toward the limit knob 40. The indication portion 6 of the indicator 5 and is visible from the window 401 of the limit knob 40 when the indicator 5 is in the indicative position. Preferably, the indication portion 6 of the indicator 5 is a color, character, number or pattern. For examples, the indication portion 6 of the indicator 5 is printed in red, and the other portion of the indicator 5 is printed in green. Hence, the red of the indication portion 6 clearly visible from the window 401 presents the lock core 41 of the lock mechanism 4 is operated or used.

Figure 7:
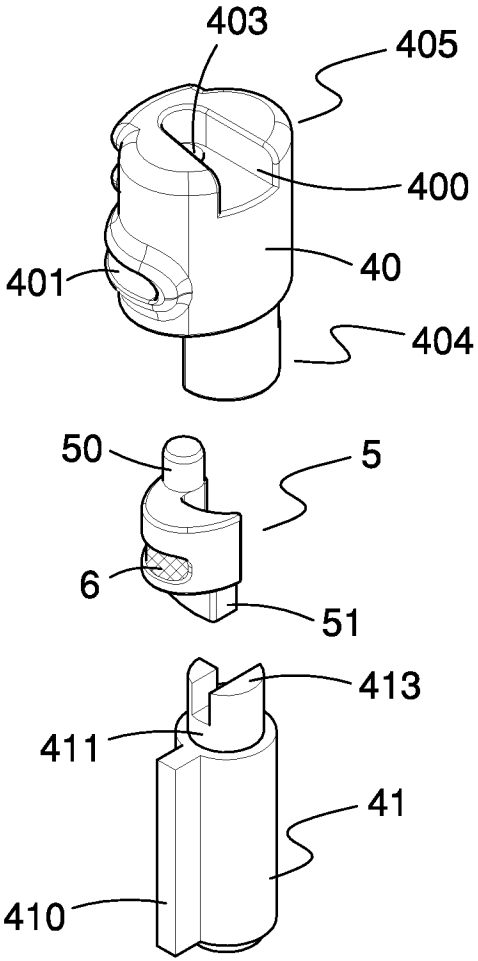
FIG. 7 is an exploded partial view of the padlock in another position than that is shown in FIG. 5.

Furthermore, FIGS. 6-8 show that the button 405 of the limit knob 40 is formed with a chamber 402 facing the shell 1 for receiving the indicator 5. The indicator 5 includes, on a second side, a guide portion 51 formed with a first ramp 510. The recess 400 of the limit knob 40 includes an aperture 403 in communication with the chamber 402. The shaft 50 of the indicator 5 can be inserted into the aperture 403 of the limit knob 40. Additionally, the shell 1 includes a second ramp 10 complementarily in contact with the first ramp 510 of the guide portion 51 of the indicator 5.

Figure 10:
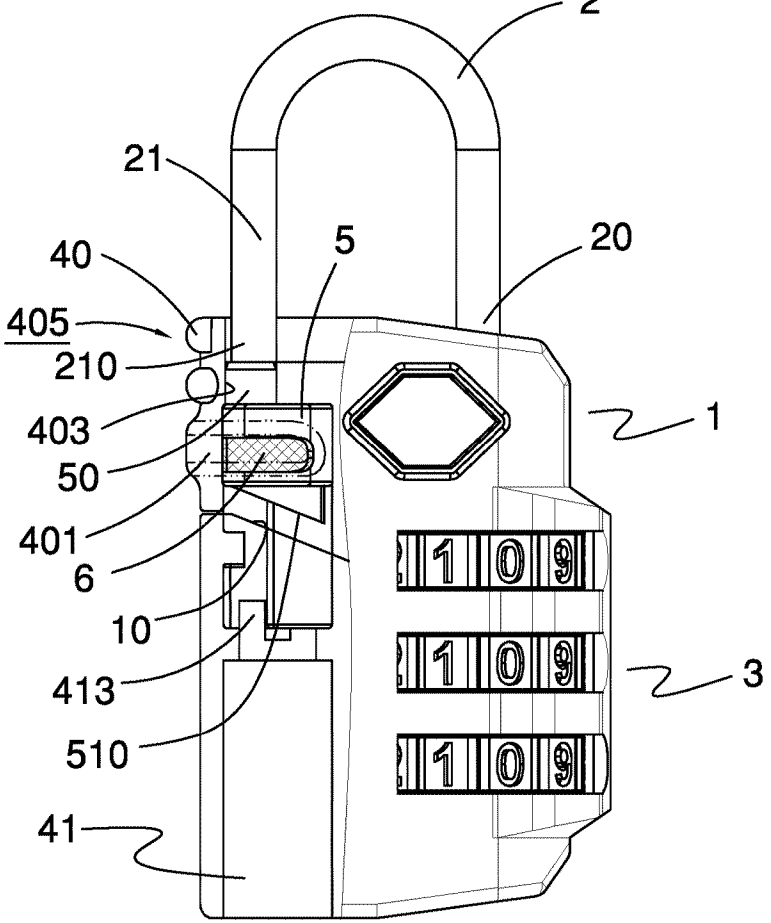
FIG. 10 is a side view of the padlock in another position than that is shown in FIG. 9.
Figure 9:
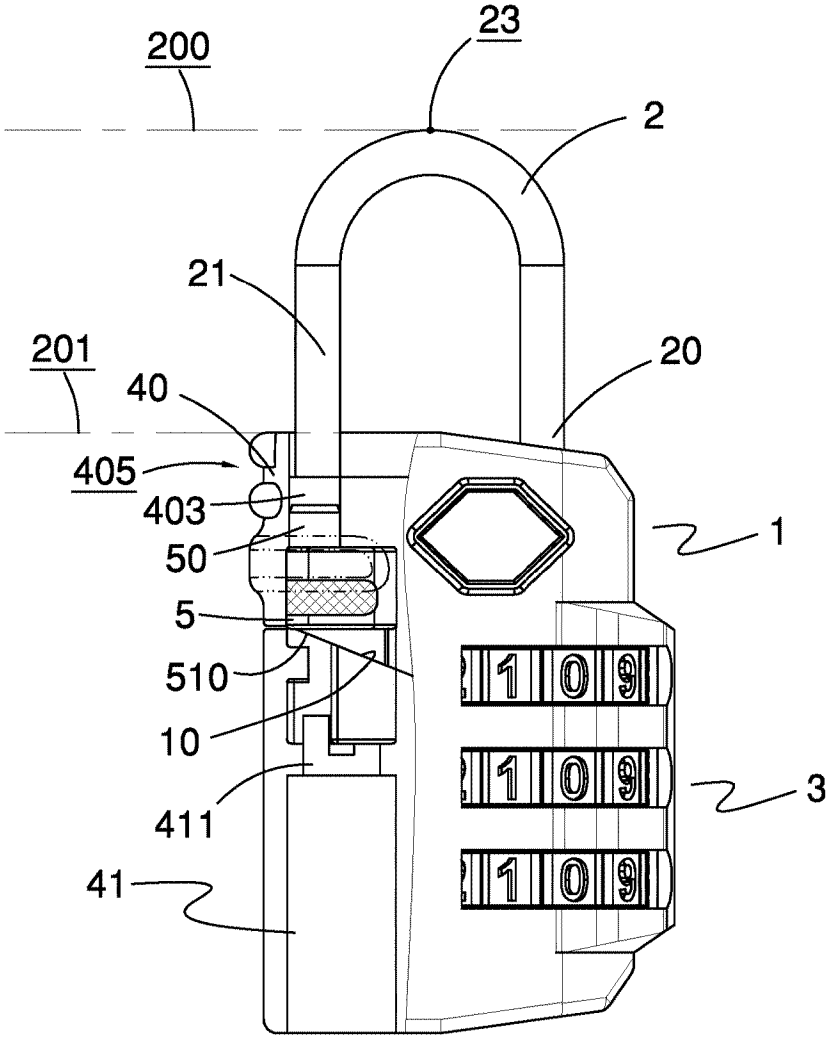
FIG. 9 is a side view of the padlock shown in FIG. 1.

Referring to FIG. 9, the first ramp 510 of the indicator 5 is in contact with the second ramp 10 of the shell 1 so that the indication portion 6 is hidden and not exposed in the window 401 of the limit knob 40. This indicates that the lock mechanism 4 has not been operated or used. Referring to FIG. 10, as the driving portion 413 of the rotor 411 of the lock mechanism 4 is rotated by the matching key, the limit knob 40 is rotated accordingly until the open end of the recess 400 of the limit knob 40 is released from the shell 1, thereby releasing the short leg 21 of the shackle 2 from the recess 400 of the limit knob 40 and allowing the short leg 21 to rotate freely about the long leg 20 of the shackle 2 to the unlocked state. At this time, the shaft 50 of the indicator 5 is located in the aperture 403 of the limit knob 40. The indicator 5 is driven by the limit knob 40 when the limit knob 40 is rotated by the lock core 41. The indicator 5 is lifted to the indicative position by engagement of the first ramp 510 of the indicator 5 with the second ramp 10 of the shell 1 so that the indication portion 6 is exposed and visible from the window 401 of the limit knob 40. As shown in FIGS. 9-10, the indicator 5 moves from an original position, toward a first horizontal level 200 that is tangent to the vertex 23 of the arch section of the shackle 2, to the indicative position outside the shell 1 in response to a key operation of the lock core 41. Wherein, when the indicator 5 is located in the indicative position, the indicator 5 is below a second horizontal level 201 that is defined on a top surface of the button 405.

After the limit knob 40 is again rotated by the lock core 41 to re-lock the short leg 21 of the shackle 2, the indicator 5 is slightly stuck in the chamber 402 and the aperture 403 of the limit knob 40 so that the indicator 5 is not moved along with the driving member 404 of the limit knob 40, i.e., the indicator 5 is kept in the indicative position. This indicates that the lock mechanism 4 has been operated. Additionally, as the combination lock core 3 is unlocked, the end 210 of the short leg 21 of the shackle 2 can be pushed into the aperture 403 of the limit knob 40 so as to push the shaft 50 of the indicator 5 downward to move the indicator 5 off the indicative position, namely to reset the indication portion 6. Alternatively, the shackle 2 can be pulled outward and rotated away from the limit knob 40 to allow an insert (not shown) inserting into the aperture 403 of the limit knob 40, thereby pushing the shaft 50 of the indicator 5 downward to have the indicator 5 move off the indicative position.

Figure 11:
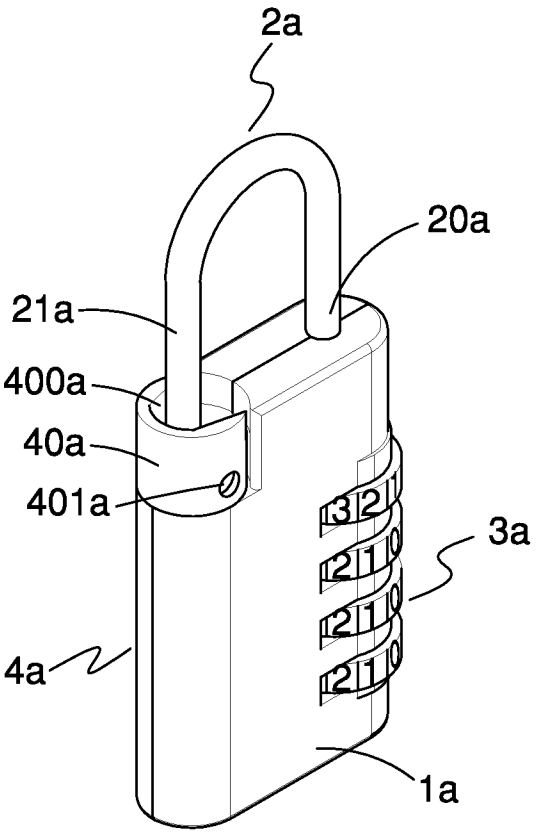
FIG. 11 is a perspective view of a padlock in accordance with a second embodiment of the present invention.

Referring to FIG. 11, a padlock in accordance with a second embodiment of the present invention includes a structure like that of the first embodiment.

Figure 12:
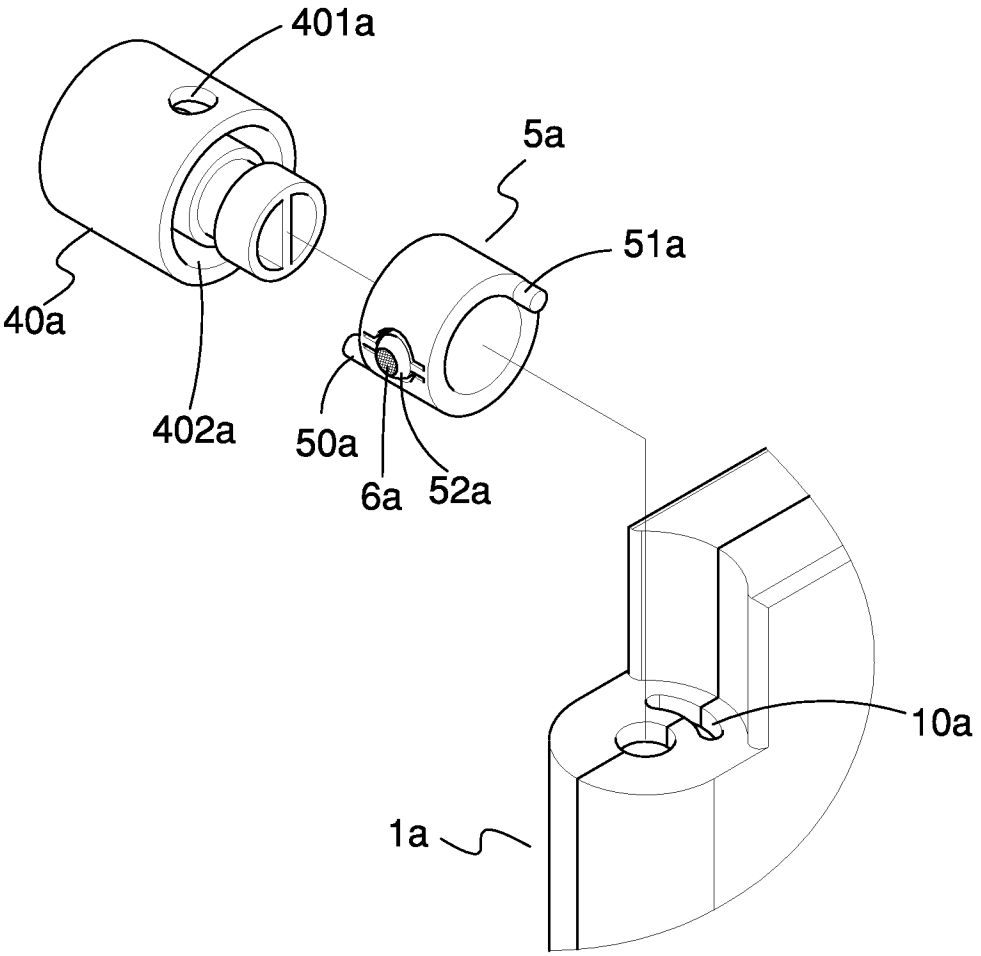
FIG. 12 is an exploded partial view of the padlock shown in FIG. 11.

Referring to FIG. 12, a shell 1*a* includes an arc-shaped slot 10*a*, and an indicator 5*a* includes a first side provided with a first post 50*a* and a second side provided with a second post 51*a* inserted in the slot 10*a* of the shell 1*a* in a sliding manner. The indicator 5*a* includes a periphery provided with an elastic protrusion 52*a* corresponding to the window 401*a* of the limit knob 40*a*, and the indication portion 6*a* is mounted on the elastic protrusion 52*a*.

Figure 13:
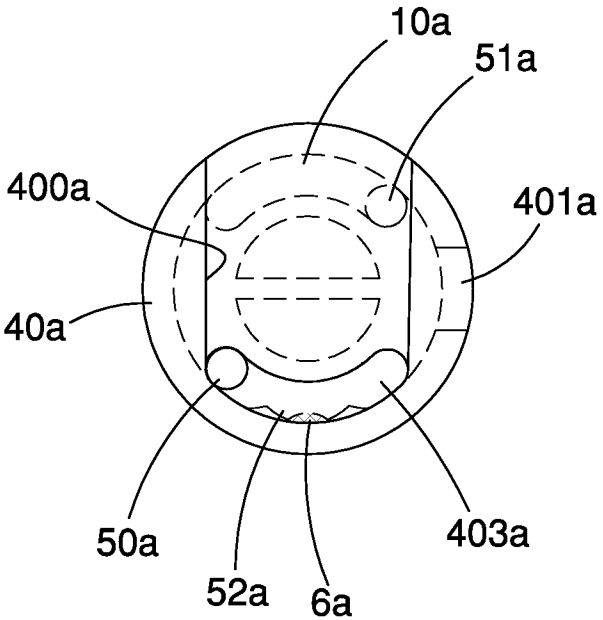
FIG. 13 is a top view of the padlock shown in FIG. 12.

Referring to FIG. 13, a recess 400*a* of a limit knob 40*a* includes an arc-shaped slot 403*a* in communication with a chamber 402*a*, and the first post 50*a* of an indicator 5*a* is inserted in the slot 403*a* of the limit knob 40*a* in a sliding manner.

Figure 14:
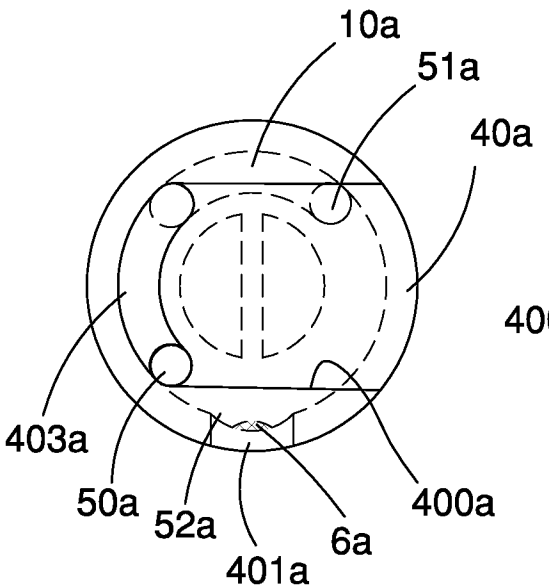
FIG. 14 is a top view of the padlock in another position than that is shown in FIG. 13.

Referring to FIG. 14, the limit knob 40*a* is rotated clockwise so that the recess 400*a* of the limit knob 40*a* is in the opened or unlocked state. At the time, the second post 51*a* of the indicator 5*a* is limited by a terminal side of the slot 10*a* of the shell 1*a* so that the indicator 5*a* is not moved with the limit knob 40*a*, while a window 401*a* of the limit knob 40*a* is moved and to aligned with the elastic protrusion 52*a* so that the indication portion 6*a* is exposed and visible from the window 401*a* of the limit knob 40*a*.

Figure 15:
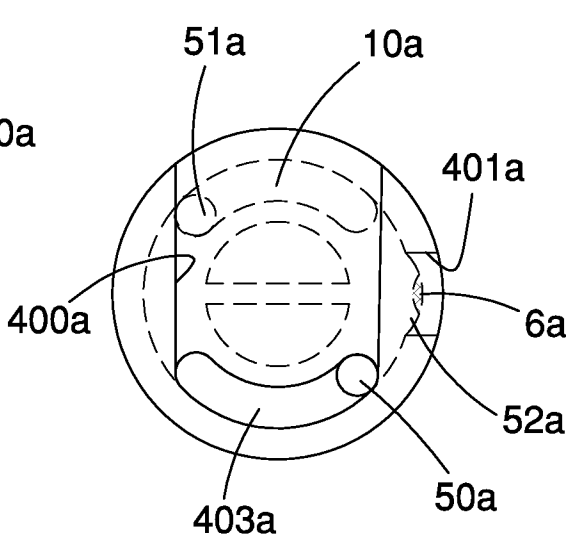
FIG. 15 is a top view of the padlock in another position than that is shown in FIG. 14.

Referring to FIG. 15, the limit knob 40*a* is rotated counterclockwise to the original position so that the recess 400*a* of the limit knob 40*a* is in the closed or locked state. At this time, the elastic protrusion 52*a* is inserted into the window 401*a* of the limit knob 40*a* so that the indicator 5*a* is moved with the limit knob 40*a*, and the indication portion 6*a* is still exposed from the window 401*a* of the limit knob 40*a*, which indicates that the lock mechanism 4*a* has been operated.

When the combination lock core 3*a* is unlocked, the shackle 2*a* is pulled outward and is rotate from the limit knob 40*a*. Then, a tool (not shown) can be inserted into the slot 403*a* of the limit knob 40*a* to cause the first post 50*a* of the indicator 5*a* to return to its original position so that the indication portion 6*a* is detached from the window 401*a* of the limit knob 40*a* and is hidden in the limit knob 40*a*.

Figure 16:
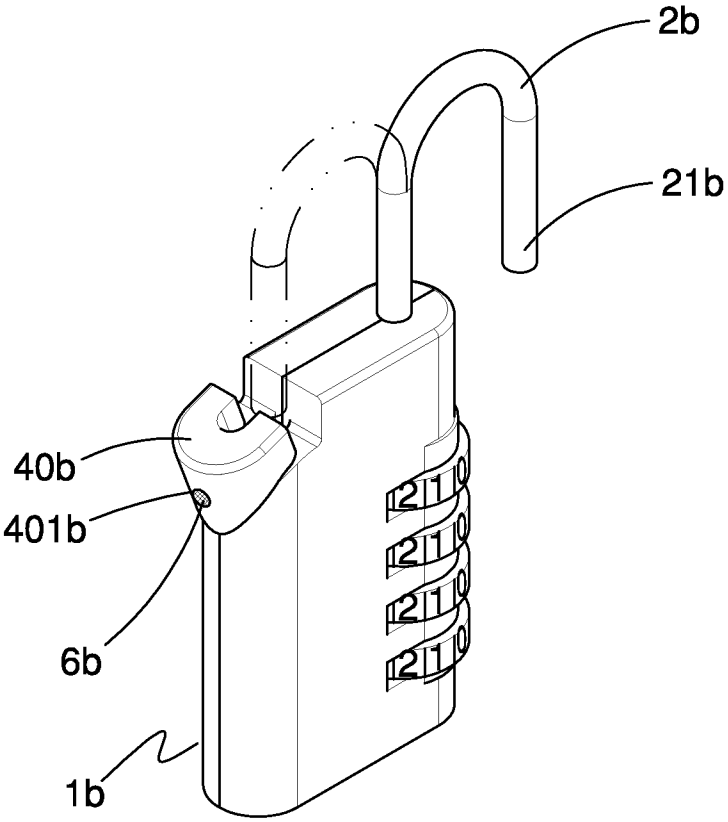
FIG. 16 is a perspective view of a padlock in accordance with a third embodiment of the present invention.

Referring to FIG. 16, a padlock in accordance with a third embodiment of the present invention includes a structure like that of the above embodiments. A limit knob 40*b* is pivotally mounted on an upper side of a shell 1*b* to limit a short leg 21*b* of a shackle 2*b* so that the short leg 21*b* of the shackle 2*b* is in a locked state, or release the short leg 21*b* of the shackle 2*b* so that the short leg 21*b* of the shackle 2*b* is in an unlocked state. When the short leg 21*b* of the shackle 2*b* is in the unlocked state, the indication portion 6*b* is moved with the limit knob 40*b* and is visible from a window 401*b* of the limit knob 40*b*.

Figure 17:
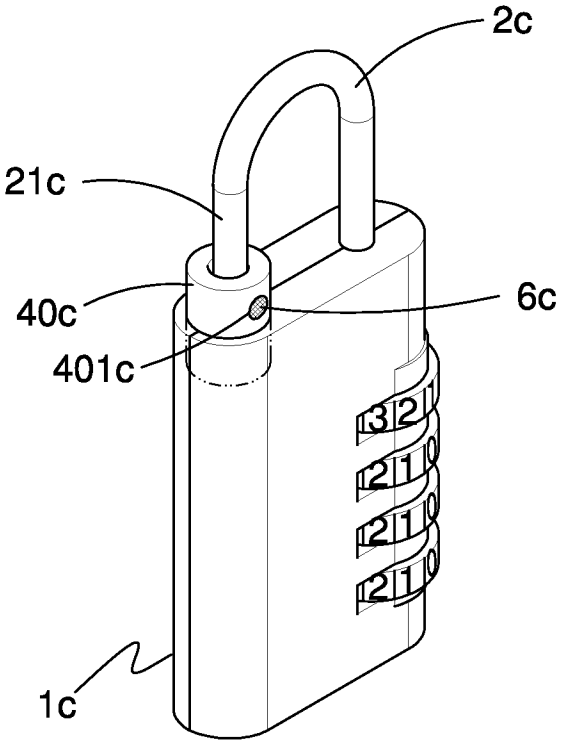
FIG. 17 is a perspective view of a padlock in accordance with a fourth embodiment of the present invention.

Referring to FIG. 17, a padlock in accordance with a fourth embodiment of the present invention includes a structure like that of the above embodiments. A limit knob 40*c* is retractably mounted on an upper side of a shell 1*c* to limit a short leg 21*c* of a shackle 2*c* so that the short leg 21*c* of the shackle 2*c* is in a locked state, or release the short leg 21*c* of the shackle 2*c* so that the short leg 21*c* of the shackle 2*c* is in an unlocked state. When the short leg 21*c* of the shackle 2*c* is in the unlocked state, the indication portion 6*c* is moved with the limit knob 40*c* and exposed from a window 401*c* of the limit knob 40*c*.

Figure 19:
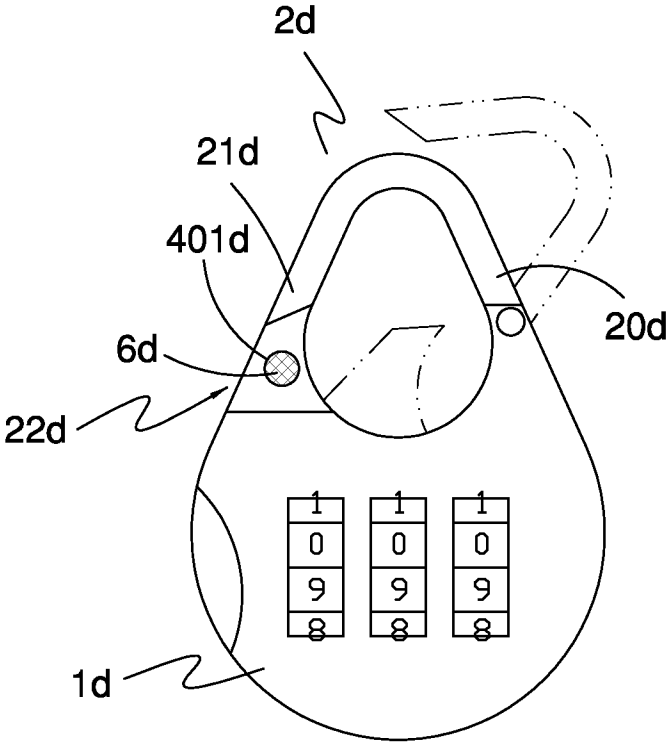
FIG. 19 is a front view of a padlock in accordance with a sixth embodiment of the present invention.
Figure 18:
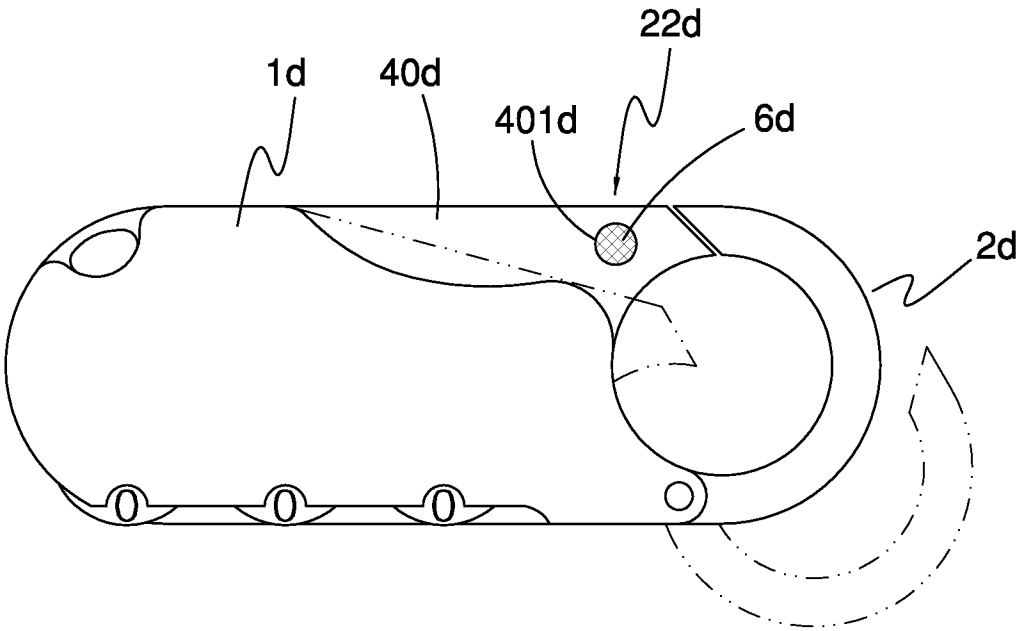
FIG. 18 is a front view of a padlock in accordance with a fifth embodiment of the present invention.

FIG. 18 shows a fifth embodiment of the present invention, and FIG. 19 shows a sixth embodiment of the present invention. Both embodiments respectively show a padlock includes a structure like that of the above embodiments. A long leg 20*d* of a shackle 2*d* is pivotally mounted on a side of a shell 1*d*, and a gap 22*d* is defined between an end of a short leg 21*d* of a shackle 2*d* and the shell 1*d*. A limit knob 40*d* is pivotally mounted on the shell 1*d* and inserted in the gap 22*d* to form a locked state. As the limit knob 40*d* is pressed towards the shell 1*d*, the gap 22*d* is opened to form an unlocked state so that the indication portion 6*d* is moved with the limit knob 40*d* and exposed from a window 401*d* of the limit knob 40*d*.

Figure 20:
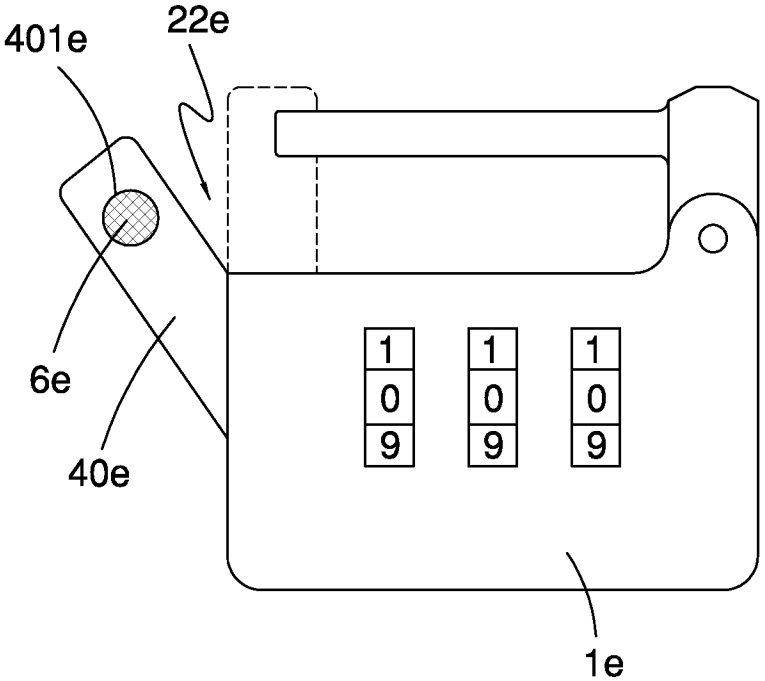
FIG. 20 is a front view of a padlock in accordance with a seventh embodiment of the present invention.

Referring to FIG. 20, a padlock in accordance with a seventh embodiment of the present invention includes a structure like that of the above embodiments. A limit knob 40*e* is pivotally mounted on the shell 1*e* and inserted in a gap 22*e* to form a locked state. When the limit knob 40*e* is moved outward relative to the shell 1*e*, the gap 22*e* is opened to form an unlocked state so that the indication portion 6*e* is moved with the limit knob 40*e* and exposed from a window 401*e* of the limit knob 40*e*.

Figure 21:
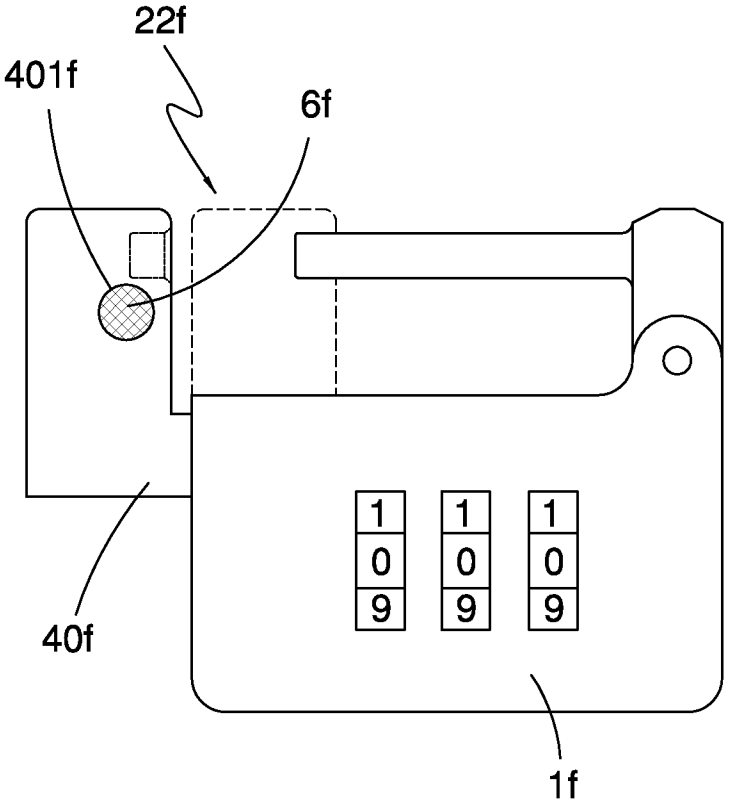
FIG. 21 is a front view of a padlock in accordance with an eighth embodiment of the present invention.

Referring to FIG. 21, a padlock in accordance with an eighth embodiment of the present invention includes a structure like that of the above embodiments. A limit knob 40*f* is linearly and movably mounted on a shell 1*f* and inserted in a gap 22*f* to form a locked state. As the limit knob 40*f* is linearly moved outward relative to the shell 1*f*, the gap 22*f* is opened to form an unlocked state so that an indication portion 6*f* is moved with the limit knob 40*f* and exposed from a window 401*f* of the limit knob 40*f*.

Figure 23:
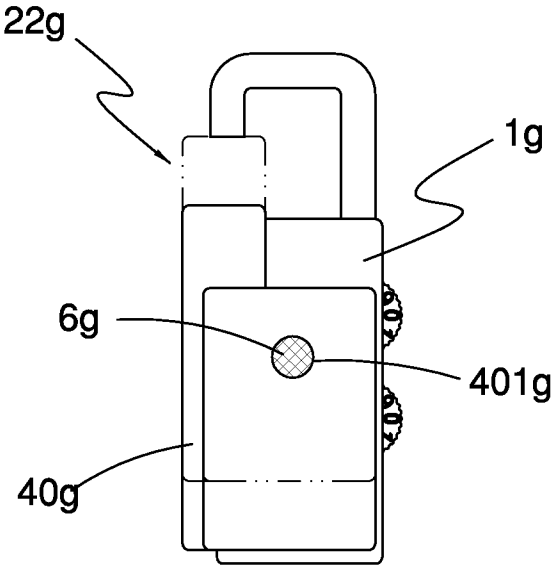
FIG. 23 is a front view of the padlock shown in FIG. 22.
Figure 22:
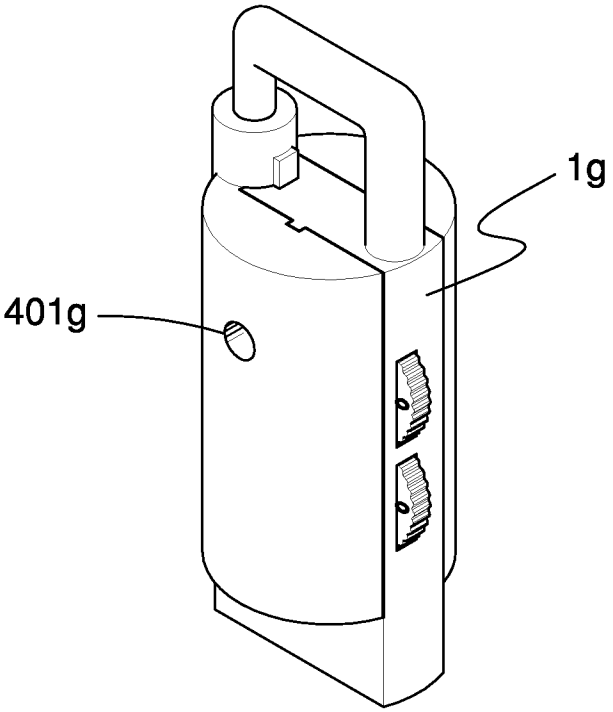
FIG. 22 is a perspective view of a padlock in accordance with a ninth embodiment of the present invention.

Referring to FIGS. 22 and 23, a padlock in accordance with a ninth embodiment of the present invention includes a structure like that of the above embodiments. A limit knob 40*g* is partially extended from a side of a shell 1*g* and is longitudinally movable on the shell 1*g* to open a gap 22*g* so as to form an unlocked state so that an indication portion 6*g* is moved with the limit knob 40*g* and exposed from a window 401*g* of the limit knob 40*g*.

Figure 24:
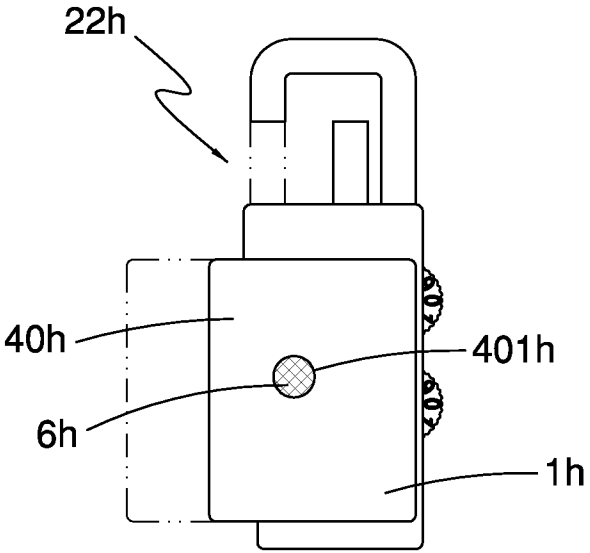
FIG. 24 is a front view of a padlock in accordance with a tenth embodiment of the present invention.

Referring to FIG. 24, a padlock in accordance with a tenth embodiment of the present invention includes a structure like that of the above embodiments. A limit knob 40*h* is transversely movable on a shell 1*h* to open a gap 22*h* so as to form an unlocked state so that an indication portion 6*h* is moved with the limit knob 40*h* and exposed from a window 401*h* of the limit knob 40*h*.

Figure 25:
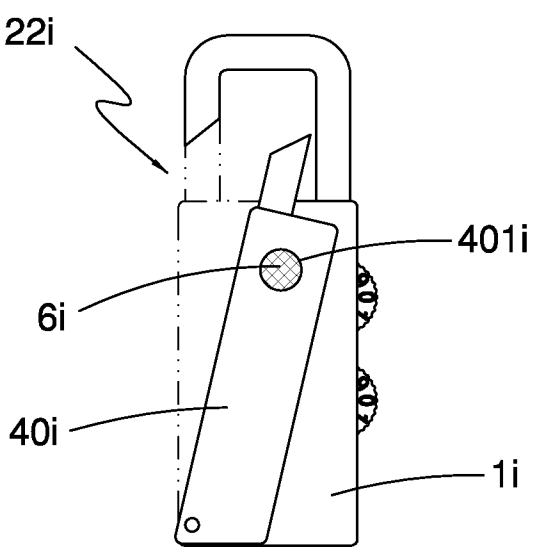
FIG. 25 is a front view of a padlock in accordance with an eleventh embodiment of the present invention.

Referring to FIG. 25, a padlock in accordance with an eleventh embodiment of the present invention includes a structure like that of the above embodiments. A limit knob 40*i* includes an end pivotally mounted on a bottom of a shell 1*i*. Thus, the limit knob 40*i* is pivoted on the shell 1*i* to open a gap 22*i* so as to form an unlocked state so that an indication portion 6*i* is moved with the limit knob 40*i* and exposed from a window 401*i* of the limit knob 40*i*.

After a customs inspector includes unlocked the padlock for checking the luggage, case or bag, the indication portion is exposed and visible from the window of the limit knob for reminding a padlock owner whose padlock has been operated or used and luggage may have been inspected by the customs inspector. In addition, the padlock owner can directly and easily judge if the customs inspector includes operated or used the padlock for checking the luggage. Furthermore, in the present invention, the indicator can be moved to the indicative position not only by using the matching key to operate the lock core of the lock mechanism as above described, but also by any object which can reach or access to the lock core of the lock mechanism, especially the object which can reach or access to the indicator via the lock core, so as to further remind the padlock owner that the lock mechanism of the padlock has been used or touched.

In the foregoing embodiments, the indicator is inserted in the limit knob. However, in another embodiment or application, the indicator can be mounted outside the limit knob entirely or partially, and the window of the limit knob can be omitted. In the foregoing embodiments, the indicator can be moved in a linear manner, i.e., lifted and lowered. In another embodiment or application, the indicator can however be moved in an angular manner, i.e., pivoted. In the foregoing embodiments, the lock core of the lock mechanism can include a first member non-movably inserted in the shell of the padlock, and a second member movably inserted in the first member and can be rotated by the matching key. However, in another embodiment, the lock core of the lock mechanism can be a one-piece element movably inserted in the shell of the padlock and can be rotated by the matching key.

Although the invention has been explained in relation to the foregoing embodiments, it is to be understood that many modifications and variations can be made without departing from the scope of the present invention. It is contemplated that the appended claim or claims will cover such modifications and variations that fall within the true scope of the invention.

What is claimed is:

1. A padlock comprising:

a shell;

a shackle having a long leg rooted in the shell, an arch section extending from the long leg and disposed outside the shell, and a short leg extending from the arch section and disposed outside the shell, wherein the short leg is rotatable about the long leg;

a button, disposed on the shell and configured to move to a blocking position to block the short leg from rotation about the long leg, and to an unblocking position to permit the rotation of the short leg about the long leg;

a key-operated lock core, disposed in the shell and configured to drive the button in one direction to the blocking position and in a reverse direction to the unblocking position, wherein the key-operated lock core defines a key hole therein to receive a key; and an indicator disposed at the shell, and the indicator moves from an original position, toward a first horizontal level that is tangent to the vertex of the arch section of the shackle, to an indicative position in responsive to a key operation of the key-operated lock core, and once arrived in the indicative position, the indicator is irresponsive to any further key operation of the key-operated lock core, wherein the indicator has an indicative surface, and when the indicator is in the original position, the indicative surface of the indicator is invisible from outside of the padlock; and when the indicator is in the indicative position, the indicative surface of the indicator is visible from the outside of the padlock.

2. The padlock of claim 1, further comprising a combination lock core disposed in the shell for controlling upward and downward movement of the shackle.

3. The padlock of claim 1, wherein the indicator is linearly movable upon the button.

4. The padlock of claim 1, wherein when the button is in the blocking position, a second horizontal level is defined on a top surface of the button, and when located in the indicative position, the indicator is below the second horizontal level.

5. The padlock of claim 4, wherein for the indicator, the original position is right below the indicative position.

6. A padlock comprising:

a shell;

a shackle having a long leg rooted in the shell, an arch section extending from the long leg and disposed outside the shell, and a short leg extending from the arch section and disposed outside the shell, wherein the short leg is rotatable about the long leg;

a button, disposed on the shell and configured to move to a blocking position to block the short leg from rotation about the long leg, and to an unblocking position to permit the rotation of the short leg about the long leg;

a combination lock core disposed in the shell for controlling upward and downward movement of the shackle;

a key-operated lock core, disposed in the shell and configured to drive the button in one direction to the blocking position and in a reverse direction to the unblocking position; and an indicator disposed at the shell, and being movable with respect to the key-operated lock core and with respect to the button, wherein the indicator is movable from an original position, toward a first horizontal level that is tangent to the vertex of the arch section of the shackle, to an indicative position, wherein the indicator has an indicative surface, and when the indicator is in the original position, the indicative surface of the indicator is invisible from outside of the padlock; and when the indicator is in the indicative position, the indicative surface of the indicator is visible from the outside of the padlock.

7. The padlock of claim 6, wherein the key-operated lock core is unable to move linearly.

8. The padlock of claim 6, wherein the indicator is linearly movable upon the button.

9. The padlock of claim 6, wherein when the button is in the blocking position, a second horizontal level is defined on a top surface of the button, and when located in the indicative position, the indicator is below the second horizontal level.

10. The padlock of claim 9, wherein for the indicator, the original position is right below the indicative position.

11. A padlock comprising:

a shell;

a shackle having a long leg rooted in the shell, an arch section extending from the long leg and disposed outside the shell, and a short leg extending from the arch section and disposed outside the shell, wherein the short leg is rotatable about the long leg;

a button, disposed on the shell and configured to move to a blocking position to block the short leg from rotation about the long leg, and to an unblocking position to permit the rotation of the short leg about the long leg;

a key-operated lock core, disposed in the shell and configured to drive the button in one direction to the blocking position and in a reverse direction to the unblocking position, wherein the key-operated lock core defines a key hole to receive a key; and an indicator being ring-shaped, mounted around the button and being displaceable with respect to the button.

12. The padlock of claim 11, further comprising a combination lock core disposed in the shell for controlling upward and downward movement of the shackle.

13. The padlock of claim 11, wherein the key-operated lock core is unable to move linearly.

14. The padlock of claim 11, wherein the indicator is movable with respect to the key-operated lock core, and the indicator is movable from an original position, toward a first horizontal level that is tangent to the vertex of the arch section of the shackle, to an indicative position, wherein the indicator has an indicative surface, and when the indicator is in the original position, the indicative surface of the indicator is invisible from outside of the padlock; and when the indicator is in the indicative position, the indicative surface of the indicator is visible from the outside of the padlock.

15. The padlock of claim 14, wherein when the button is in the blocking position, a second horizontal level is defined on a top surface of the button, and when located in the indicative position, the indicator is below the second horizontal level.

16. The padlock of claim 15, wherein for the indicator, the original position is right below the indicative position.

* * * * *